US007179341B2

(12) United States Patent
Harakawa

(10) Patent No.: US 7,179,341 B2
(45) Date of Patent: Feb. 20, 2007

(54) INTEGRATED SPROCKET AND HOUSING AND MANUFACTURING METHOD THEREFOR

(75) Inventor: Toshiro Harakawa, Niigata (JP)

(73) Assignee: Mitsubishi Materials Corporation, Tokyo (JP)

( * ) Notice: Subject to any disclaimer, the term of this patent is extended or adjusted under 35 U.S.C. 154(b) by 466 days.

(21) Appl. No.: 10/666,858

(22) Filed: Sep. 19, 2003

(65) Prior Publication Data

US 2004/0116223 A1 Jun. 17, 2004

(30) Foreign Application Priority Data

Sep. 20, 2002 (JP) ..... 2002-275411

(51) Int. Cl.
*C23C 8/26* (2006.01)
*F16H 55/06* (2006.01)
*F16H 55/30* (2006.01)

(52) U.S. Cl. ..... 148/318; 474/152; 474/161

(58) Field of Classification Search ..... 474/152, 474/161; 148/318
See application file for complete search history.

(56) References Cited

U.S. PATENT DOCUMENTS 4,131,492 A * 12/1978 Fushimi et al. ..... 148/217
6,314,929 B1 11/2001 Macyama et al.
6,318,327 B1 11/2001 Takahashi et al.

FOREIGN PATENT DOCUMENTS

| | | | |
|---|---|---|---|
| DE | 2715745 A | * | 10/1977 |
| EP | 0 887 122 A2 | | 12/1998 |
| GB | 607 701 A1 | | 9/1948 |
| GB | 1 443 894 A1 | | 7/1976 |
| JP | 11-093628 A1 | | 4/1999 |
| JP | 2001-342981 A1 | | 12/2001 |

* cited by examiner

*Primary Examiner*—Roy King
*Assistant Examiner*—Christopher Kessler
(74) *Attorney, Agent, or Firm*—Darby & Darby

(57) ABSTRACT

An integrated sprocket and housing used in a variable valve timing mechanism. The integrated sprocket and housing includes: a sprocket portion which is formed in a substantially annular shape, and which has teeth on the outer circumference thereof; and a housing portion which is disposed inside the sprocket portion, which has recesses in the inside thereof, and which is formed integrally with the sprocket portion as a sintered body made of a ferrous powder material, wherein the entire surface of the sprocket portion and the housing portion is covered with a steam oxidized layer which is formed by a steam treatment, and a nitrided layer which is formed by a gas soft nitriding treatment subsequent to the steam treatment.

9 Claims, 2 Drawing Sheets

INTEGRATED SPROCKET AND HOUSING AND MANUFACTURING METHOD THEREFOR

BACKGROUND OF THE INVENTION

1. Field of the Invention

The present invention relates to an integrated sprocket and housing which is, in particular, used in a variable valve timing mechanism, and which includes a sprocket portion which is formed in a substantially annular shape, and which has teeth on the outer circumference thereof, and a housing portion which is disposed inside the sprocket portion, and which has recesses in the inside thereof. The present invention also relates to a method for manufacturing an integrated sprocket and housing.

Priority is claimed on Japanese Patent application No. 2002-275411, filed Sep. 20, 2002, which is incorporated herein by reference.

2. Description of Related Art

In internal combustion engines installed in automobiles, variable valve timing mechanisms, by which open and close timing (valve timing) is changed, have been employed, in order to improve the efficiency of combustion in a low revolution range as well as in a high revolution range, and also to decrease exhaust gas.

A type of variable valve timing mechanism is known in the art, which includes a first rotational body (an inner rotor) which is connected to a camshaft so as to rotate, and a second rotational body (a housing) which is disposed coaxially with the first rotational body, and which is connected to a crankshaft so as to rotate with a sprocket (a driven gear), wherein a rotational phase is changed by rotating the first and second rotational body with respect to each other so that the valve timing is changed (see, for example, Japanese Unexamined Patent Application, First Publication No. Hei 11-93628).

In this case, in order to rotate the first and second rotational bodies (i.e., the inner rotor and housing) with respect to each other, pressure chambers are formed inside the housing, each of which is delimited by two vanes projecting outwardly from the outer circumference of the inner rotor and an inner circumferential wall of the housing, and a pressure difference is generated between two pressure chambers so that the vane disposed between the two pressure chambers is moved while sliding along the inner circumferential wall of the housing. As a result, the rotational phase between the camshaft and the crankshaft is changed so that the valve timing is changed.

In such variable valve timing mechanisms, the sprocket, which is driven by a chain, must have high surface pressure resistance, high tenacity, and high hardness in addition to low friction performance. On the other hand, the housing, on which the vane slides, must have high accuracy in shape, excellent wear resistance, and low friction performance.

The sprocket and housing rotate together; however, their requirements, such as above mechanical properties, are different; therefore, conventionally, the sprocket and housing are separately made from different materials, and made by applying different surface treatments, and then are assembled together.

A vane for a rotary compressor, an element which must have excellent wear resistance, is disclosed in Japanese Unexamined Patent Application, First Publication No. 2001-342981. The vane is manufactured by powder-forming and sintering a ferrous powder material having sufficient hardenability, and through various subsequent treatments.

After increasing the strength through quenching and annealing after sintering, the vane is subjected to a steam treatment in order to improve the sealing performance, and is further subjected to a nitriding treatment (a gas soft nitriding treatment) in order to improve wear resistance. After the steam treatment and nitriding treatment, surface finishing by grinding is applied to improve the surface roughness and accuracy in shape.

In the field of variable valve timing mechanisms, reductions in manufacturing time and cost by reducing assembling steps are required, and it is desired to integrally manufacture the housing and sprocket by powder forming and sintering.

However, a problem is encountered in that it is difficult to manufacture a housing, which must be manufactured with a precise shape, by applying various treatments to a sintered compact that is made conventionally because dimensional control is difficult.

As mentioned above, the housing, which has a slide surface for the vane, must have low friction performance, excellent wear resistance, and high accuracy in shape. On the other hand, the sprocket, which is driven by a chain, must also have high strength. When the sprocket and housing, which are conventionally made separately through respective preferred processes, are integrally manufactured, the requirements such as strength, accuracy, and low friction cannot be satisfied at the same time because different requirements are desired for different portions.

BRIEF SUMMARY OF THE INVENTION

The present invention was conceived in view of the above circumstances, and an object of the present invention is to provide an integrated sprocket and housing which satisfies the requirements such as strength, accuracy, and low friction at the same time.

Another object of the present invention is to provide a method for manufacturing an integrated sprocket and housing.

In order to achieve the above object, the present invention provides an integrated sprocket and housing which is used in a variable valve timing mechanism, the integrated sprocket and housing including: a sprocket portion which is formed in a substantially annular shape, and which has teeth on the outer circumference thereof; and a housing portion which is formed integrally with the sprocket portion as a sintered body made of a ferrous powder material so as to be disposed inside the sprocket portion, and which has recesses extending from an inner circumference of the housing portion, wherein the entire surfaces of the sprocket portion and the housing portion are covered with a steam oxidized layer which is formed by a steam treatment, and a nitrided layer which is formed by a gas soft nitriding treatment subsequent to the steam treatment.

According to the integrated sprocket and housing of the present invention, because the sprocket portion and the housing portion are integrally formed, the assembling process is simplified. In addition, the nitrided layer, which is formed after pores are filled with the steam oxidized layer, has thickness which is less than that of the steam oxidized layer, the integrated sprocket and housing has preferable low friction performance and strength due to the nitrided layer having an appropriate thickness.

In the integrated sprocket and housing, the teeth of the sprocket portion may be covered with a hardened layer which is formed by a high-frequency induction hardening process in which the teeth are heated to a temperature exceeding the transition point of the ferrous powder material.

According to the above integrated sprocket and housing, because the hardened layer is formed only on the surface of the teeth, the integrated sprocket and housing is provided with the teeth having high strength without having deformations in the sliding surface which must have high accuracy in shape. In addition, because the high-frequency induction hardening process, in which the teeth are heated to a temperature exceeding the transition point of the ferrous powder material, is applied only to the teeth in the sprocket portion, the overall shape of the integrated sprocket and housing will not be affected by the heat, and thus high accuracy in shape can be maintained.

In the integrated sprocket and housing, the steam oxidized layer may preferably be covered by the nitrided layer.

In the integrated sprocket and housing, the thickness of the steam oxidized layer may preferably be in a range from 3 to 8 μm. The thickness of the nitrided layer may preferably be in a range from 2 to 5 μm. The nitrided layer may preferably be made thinner than the steam oxidized layer.

The present invention also provides a method for manufacturing an integrated sprocket and housing including the steps of: forming a green compact of a ferrous powder material including a sprocket portion having teeth on the outer circumference thereof, and a housing portion which is disposed inside the sprocket portion, and which has recesses extending from an inner circumference of the housing portion; sintering the green compact to obtain a sintered body; subjecting the sintered body to a steam treatment in which a super-heated steam is used; subjecting the sintered body to a gas soft nitriding treatment in which an ammonium gas is used; and subjecting the teeth to a high-frequency induction hardening treatment.

In the above method, the conditions of the high-frequency induction hardening treatment may preferably be determined so that the teeth are heated to a temperature exceeding the transition point of the ferrous powder material. The temperature of the super-heated steam may preferably be set in a range from 550° C. to 600° C.

DETAILED DESCRIPTION OF THE INVENTION

An embodiment of the present invention will be explained below with reference to the appended drawings.

Figure 1:
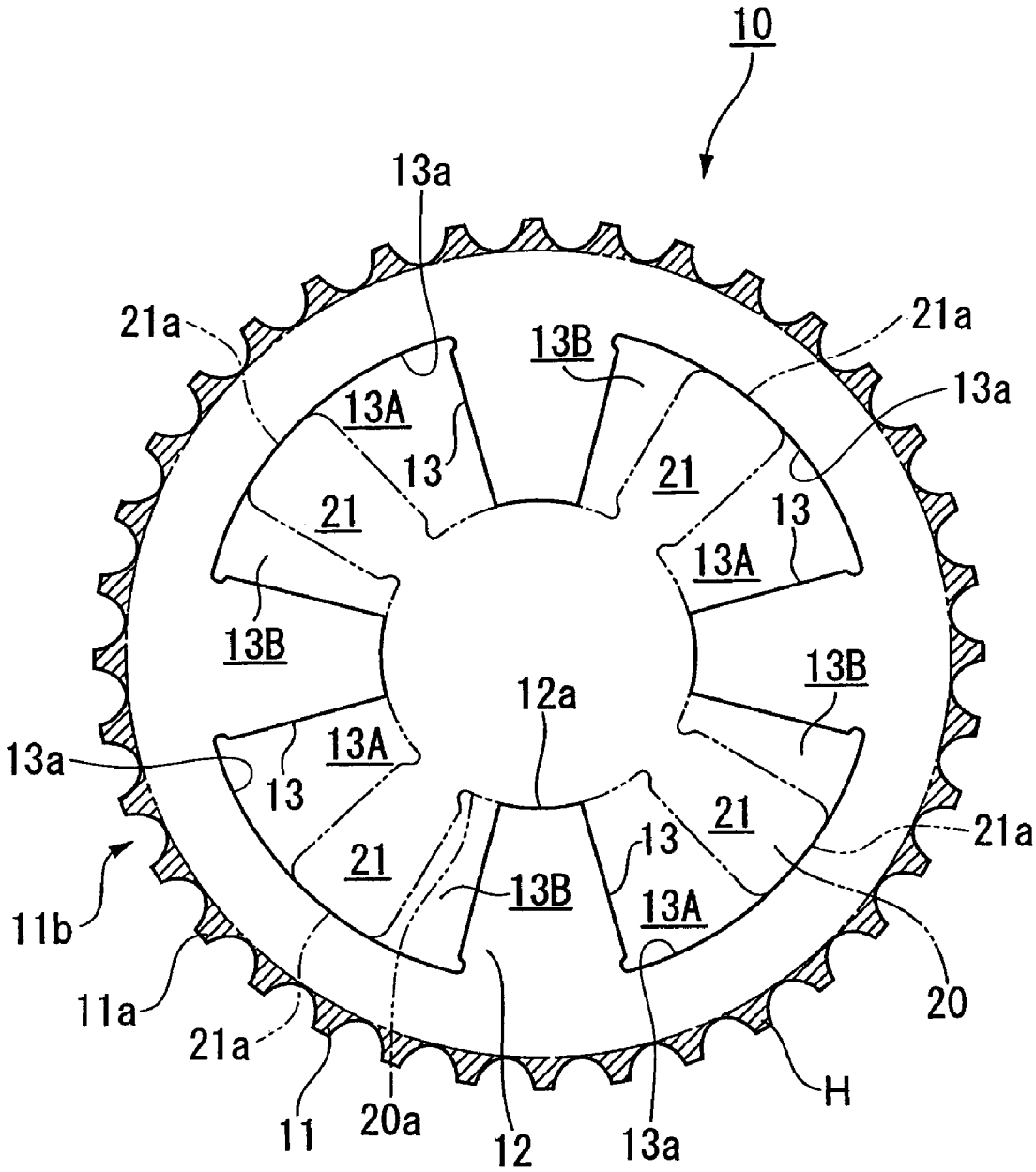
FIG. 1 is a plan view showing an integrated sprocket and housing of the present invention.

FIG. 1 shows the shape of an integrated sprocket and housing 10 of the present invention. The integrated sprocket and housing 10, which is used in a variable valve timing mechanism of an internal combustion engine installed in an automobile, is formed as a sintered body composed integrally of a ferrous powder material. The integrated sprocket and housing 10, which is formed in a substantially cylindrical shape, includes a sprocket portion 11 which is disposed in the outer circumferential area thereof, and a housing portion 12 which is disposed inside the sprocket portion 11.

The sprocket portion 11 is formed as a driving power transmission portion which, in use, engages a roller chain. The sprocket portion 11 includes teeth 11*a* formed on the outer circumference 11*b* thereof; therefore, in use, surface pressure and friction are applied to the teeth 11*a* from the roller chain.

The housing portion includes recesses 13 (four recesses are formed in this embodiment), each of which extends radially and outwardly from the inner circumference 12*a* of the housing portion. As indicated by a two-dot chain line in FIG. 1, a rotor 20 engages the inner circumference 12*a* in such a manner that a relative rotation between the housing portion 12 and the rotor 20 is allowed.

The rotor 20 has vanes 21 (four vanes are formed in this embodiment), each of which extends radially and outwardly from the outer circumference 20*a* thereof. Each of the vanes 21 is disposed in each of the recesses 13, and the tip portion 21*a* of the vane contacts the cylindrical inner surface 13*a* of the recess 13 so as to divide the recess 13 into two in the circumferential direction, and thus pressure chambers 13A and 13B are formed, each of which is delimited by the integrated sprocket and housing 10 and the rotor 20.

When the pressure in the pressure chambers 13A and 13B is maintained, the integrated sprocket and housing 10 and the rotor 20 rotate together. On the other hand, when a pressure difference is generated between the pressure chambers 13A and 13B, the vanes 21 move in the recesses 13 while sliding along the cylindrical inner surfaces 13*a* of the recesses 13 so that the integrated sprocket and housing 10 and the rotor 20 rotate with respect to each other, and thus the phase between the integrated sprocket and housing 10 and the rotor 20 can be changed.

Excellent wear resistance and high load capacity (i.e., high strength) are required for the integrated sprocket and housing 10, in particular, on the sprocket portion 11 by which driving power is transmitted using a chain. On the other hand, excellent wear resistance, low friction performance, and accuracy in shape are required for the housing portion 12 which includes the pressure chambers 13A and 13B, and along which the vanes 21 of the rotor 20 slide.

The integrated sprocket and housing 10 is manufactured through the steps of forming a green compact using a ferrous powder material (e.g., Fe-(1–4)Cu-(0.2–0.9)C, Fe-(0.6–1.6)Mo-(0.2–0.7)C), and sintering the green compact under a normal sintering temperature to obtain a sintered body, and applying various treatments to the sintered body. Here, the above expression such as Fe-(1–4)Cu-(0.2–0.9)C indicates a Fe (iron) base powder material containing 1 to 4 wt % copper and 0.2 to 0.9 wt % graphite.

Figure 2:
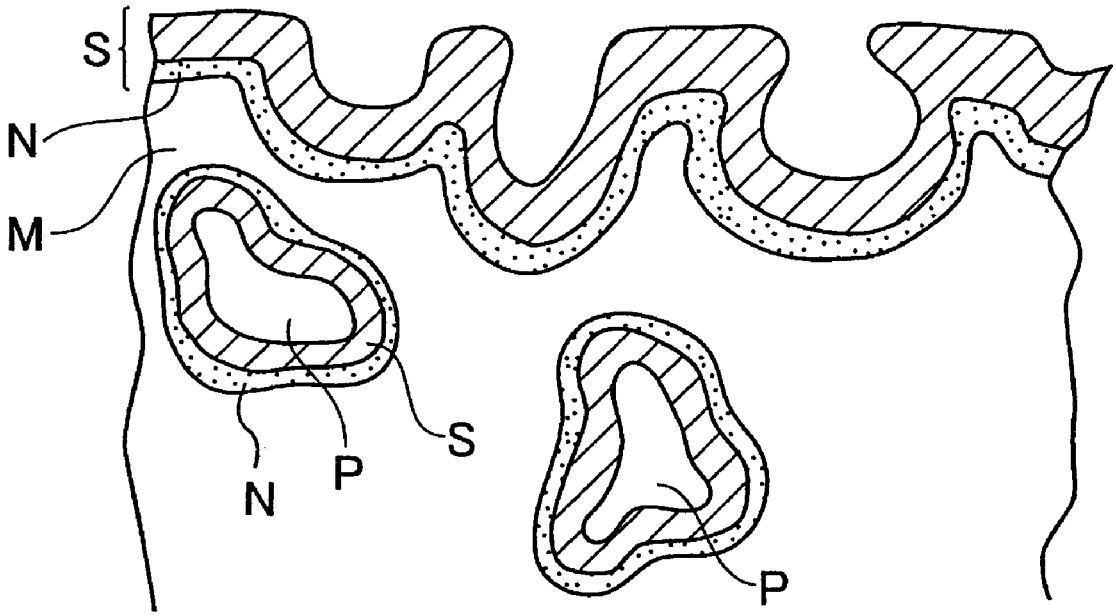
FIG. 2 is a cross-sectional view showing a portion of the integrated sprocket and housing specifically in the vicinity of the surface thereof having a covering layer.

The various treatments will be more specifically explained below with reference to FIG. 2 which is an enlarged cross-sectional view showing a portion of the integrated sprocket and housing 10, specifically, in the vicinity of the surface thereof.

First of all, the sintered body is subjected to a steam treatment in which a super-heated steam is used. The temperature of the super-heated steam is set in a range from 550° C. to 600° C. In the steam treatment, a steam oxidized layer S of triiron tetroxide ($Fe_3O_4$) is formed on the entire surface of a base material M of the sintered body. The steam oxidized layer S is formed not only on the outermost surface of the base material M, but also on the surface of open pores P (i.e., on the inside surface of each of the open pores P), and thus the open pores P in the sintered body are filled to some extent. The thickness of the steam oxidized layer S is preferably set in a range from 3 to 8 μm; however, the thickness may be set differently by, for example, changing the time for treatment as necessary. In general, the time for treatment (i.e., the time from placing the sintered body in the treatment chamber to the time until the sintered body is removed) is set in a range from 90 to 150 minutes.

Next, the sintered body is subjected to a gas soft nitriding treatment in which an ammonium gas is used. In the gas soft nitriding treatment, oxygen contained in $Fe_3O_4$ in a portion of the steam oxidized layer S located adjacent to the base material M is excited and replaced by nitrogen contained in the ammonium gas, and thus a nitrided layer N of a ferrous nitride is formed on the base material M. Because the nitrided layer N is formed in the gas soft nitriding treatment under a relatively low ambient temperature, the sintered body will not deform during the treatment, while at the same time, the surface of the integrated sprocket and housing 10 can be made harder than the vanes 21, i.e., the wear resistance of the surface of the integrated sprocket and housing 10 can be ensured.

The thickness of the nitrided layer N is preferably set in a range from a lower limit, which is determined in view of the improvement in wear resistance and low friction performance, to an upper limit, which is determined in view of preventing degradation of tenacity of the integrated sprocket and housing 10. In this embodiment, the thickness of the nitrided layer N is set in a range from 2 to 5 μm; however, the thickness may be freely set to a value less than that of the steam oxidized layer S by, for example, changing the time for treatment as necessary. By adjusting the thickness of the steam oxidized layer S in an appropriate range, the nitrided layer N is prevented from being formed too thick, and thus the integrated sprocket and housing 10 can be prevented from losing tenacity, which is caused by a too thick nitrided layer N.

Through the above steam treatment and the gas soft nitriding treatment, the hardness of the surface of the sintered body is increased due to the steam oxidized layer S and the nitrided layer N formed thereon, and the wear resistance and low friction performance are also improved, while at the same time, the dimensional accuracy is maintained.

Furthermore, in order to make the teeth 11*a* formed on the outer circumference 11*b* be sufficiently hard to resist a high load applied thereto by a chain, a high-frequency induction hardening process is applied. The high-frequency induction hardening process is preferable in view of forming a local hardened layer, and will have just a small effect on the dimensional accuracy. By the high-frequency induction hardening process, a hardened layer H is formed only on the teeth 11*a* (FIG. 1), and thus the teeth 11*a* are provided with a sufficient surface strength (hardness).

In the case as explained above in which the high-frequency induction hardening process is applied to the teeth 11*a* after the gas soft nitriding treatment, the hardness of the teeth 11*a* can be increased when compared with another case in which merely the high-frequency induction hardening process is applied to the teeth 11*a* without the gas soft nitriding treatment. More specifically, when Fe-2.0Cu-0.6C is used as the ferrous powder material, and when the density after sintering is 6.8 g/cm$^3$, the hardness of the teeth 11*a* would be 700 to 750 (MHv (25 g)) when only the high-frequency induction hardening process is applied. In contrast, when the high-frequency induction hardening process is applied after the gas soft nitriding treatment, the hardness of the teeth 11*a* would be 770 to 820 (MHv). As a reference, the hardness of the teeth 11*a* would be 450 to 500 (MHv) when only the gas soft nitriding treatment is applied.

In addition to the above treatments, machining processes such as sizing, trimming, and grinding are applied to the sintered body as necessary to complete fabrication of the integrated sprocket and housing 10.

The overall density of the integrated sprocket and housing 10 thus obtained will be from 6.6 to 7.2 g/cm$^3$, and the local density in the vicinity of the teeth 11*a* will be from 6.8 to 7.3 g/cm$^3$. The entire surface of the integrated sprocket and housing 10 is covered with the steam oxidized layer S and the nitrided layer N so as to exhibit excellent low friction performance and wear resistance. In addition, the teeth 11*a* are provided with the hardened layer H so as to exhibit high hardness and high load capacity. In the present embodiment, the sprocket portion, which directly transfers load to the chain, is not only made denser, but also harder, by the surface treatment when compared with the housing portion taking into consideration use of the sprocket portion under severe conditions.

Advantageous Effects Obtainable by the Invention

As explained above, according to the integrated sprocket and housing of the present invention, because the sprocket portion and the housing portion are integrally formed, the assembling process is simplified, and manufacturing cost can be reduced. In addition, the integrated sprocket and housing has excellent low friction performance and strength due to the nitrided layer having an appropriate thickness.

According to another integrated sprocket and housing of the present invention, because the hardened layer is formed only on the surface of the teeth, the integrated sprocket and housing is provided with the teeth having high strength without having deformation in the sliding surface which must have high accuracy in shape. In addition, because the high-frequency induction hardening process, in which the teeth are heated to a temperature exceeding the transition point of the ferrous powder material, is applied only to the teeth in the sprocket portion, the overall shape of the integrated sprocket and housing will not be affected by heat, and thus high accuracy in shape can be maintained. The hardness of the teeth can be increased by applying the high-frequency induction hardening process after the gas soft nitriding treatment when compared with another case in which only the high-frequency induction hardening process is applied to the teeth.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description and is only limited by the scope of the appended claims.

What is claimed is:

1. An integrated sprocket and housing which is used in a variable valve timing mechanism, the integrated sprocket and housing comprising:

a sprocket portion which is formed in a substantially annular shape, and which has teeth on the outer circumference thereof; and a housing portion which is formed integrally with the sprocket portion as a sintered body made of a ferrous powder material so as to be disposed inside the sprocket portion, and which has recesses extending from an inner circumference of the housing portion, wherein the entire surfaces of the sprocket portion and the housing portion are covered with:

a steam oxidized layer, which is formed by a steam treatment; and a nitrided layer which has a thickness in a range from 2 to 5 μm, is thinner than the steam oxidized layer, and is formed by a gas soft nitriding treatment subsequent to the steam treatment.

2. An integrated sprocket and housing according to claim 1, wherein the teeth of the sprocket portion are covered with a hardened layer which is formed by a high-frequency induction hardening process in which the teeth are heated to a temperature exceeding the transition point of the ferrous powder material.

3. An integrated sprocket and housing according to claim 1, wherein the steam oxidized layer is covered by the nitrided layer.

4. An integrated sprocket and housing according to claim 1, wherein the thickness of the steam oxidized layer is in a range from 3 to 8 μm.

5. An integrated sprocket and housing according to claim 1, wherein a hardness of the teeth is from 450 to 500 (MHv (25 g)).

6. An integrated sprocket and housing according to claim 2, wherein a hardness of the teeth is from 770 to 850 (MHv (25 g)).

7. An integrated sprocket and housing according to claim 2, wherein an overall density thereof is from 6.6 to 7.2 g/cm$^3$.

8. An integrated sprocket and housing according to claim 2, wherein a local density in a vicinity of the teeth is from 6.8 to 7.3 g/cm$^3$.

9. An integrated sprocket and housing comprising:

a sprocket portion which is formed in a substantially annular shape, and which has teeth on the outer circumference thereof; and a housing portion which is formed integrally with the sprocket portion as a sintered body made of a ferrous powder material so as to be disposed inside the sprocket portion, and which has recesses extending from an inner circumference of the housing portion, wherein each of the recesses includes an arc-shaped slide surface which is located at the backside of the teeth, and which allows another element to slide along, and wherein the entire surfaces of the sprocket portion and the housing portion are covered with:

a steam oxidized layer which is formed by a steam treatment: And a nitrided layer having a thickness in a range from 2 to 5 μm, is thinner than the steam oxidized layer, and is formed by a gas soft nitriding treatment subsequent to the steam treatment.

* * * * *